US007717279B2

(12) United States Patent
Lawson

(10) Patent No.: US 7,717,279 B2
(45) Date of Patent: May 18, 2010

(54) SLATWALL TRACK

(76) Inventor: Stephen Lawson, 1947 Ocean Park Road, Surrey, B.C. (CA) V4A 3M2

( * ) Notice: Subject to any disclaimer, the term of this patent is extended or adjusted under 35 U.S.C. 154(b) by 130 days.

(21) Appl. No.: 11/890,571

(22) Filed: Aug. 8, 2007

(65) Prior Publication Data

US 2008/0000862 A1 Jan. 3, 2008

(51) Int. Cl.
*A47F 5/08* (2006.01)

(52) U.S. Cl. ..... 211/94.01; 211/103

(58) Field of Classification Search ..... 211/86.01, 211/87.01, 94.01, 106, 50, 103, 187, 189, 211/190, 207; 248/220.21, 220.31, 223.41, 248/225.21, 225.11; 52/36.5, 36.6, 506.08, 52/512, 592.1, 710; D25/123
See application file for complete search history.

(56) References Cited

U.S. PATENT DOCUMENTS 576,569 A * 2/1897 Gemmer ..... 52/592.1
813,816 A * 2/1906 McVey ..... 256/50
1,281,416 A * 10/1918 Pratt ..... 52/710
1,921,261 A * 8/1933 Potter ..... 296/92
2,142,110 A * 1/1939 Calkins et al. ..... 52/579
3,085,367 A * 4/1963 De Ridder et al. ..... 52/538
3,235,218 A * 2/1966 Graham ..... 248/223.41
3,264,792 A * 8/1966 Drazdik et al. ..... 52/508
3,352,428 A * 11/1967 Sak et al. ..... 211/106.01
3,417,519 A * 12/1968 Hitter ..... 52/530
3,532,317 A * 10/1970 Adler ..... 248/223.31
3,698,565 A * 10/1972 Weber ..... 211/87.01
3,759,007 A * 9/1973 Thiele ..... 52/533
4,099,358 A * 7/1978 Compaan ..... 52/588.1
4,126,230 A * 11/1978 Tyson et al. ..... 211/50
4,154,421 A * 5/1979 Suvitie ..... 248/327
4,236,366 A * 12/1980 Rijnders ..... 52/580
4,323,163 A * 4/1982 Johns ..... 211/189
4,420,087 A * 12/1983 Johns ..... 211/189
4,450,970 A * 5/1984 Shepherd ..... 211/189
4,531,331 A * 7/1985 Itagaki ..... 52/38
4,572,381 A * 2/1986 Breakey et al. ..... 211/94.01
4,603,068 A * 7/1986 Hunter ..... 428/54
4,607,753 A * 8/1986 Radek ..... 211/94.01
4,618,192 A * 10/1986 Kelley ..... 312/245
4,632,260 A * 12/1986 Hart et al. ..... 211/189
4,672,789 A * 6/1987 Fortier ..... 52/520
4,674,240 A * 6/1987 Strausheim ..... 52/36.4
4,679,368 A * 7/1987 Pettinga et al. ..... 248/225.11
4,750,624 A * 6/1988 Baron ..... 211/87.01

(Continued)

*Primary Examiner*—Michael Safavi
*Assistant Examiner*—Joshua Rodden
(74) *Attorney, Agent, or Firm*—Frederick Kaufman

(57) ABSTRACT

A slatwall track, which comprises a horizontally elongated assembly of uniform thickness and has a front and a back side, incorporates an upwardly extending member, retracted from the front side, for intermeshing with a downwardly extending member, coplanar with the front side, of another above located slatwall track. The slatwall track further incorporates one or more channel subassemblies for supporting items. The channel subassemblies are generally followed downwardly by rigidity boxes. A member for stopping projecting backwardly from the downwardly extending member limits an upward movement of a lower slatwall rack during intermeshing. The spacing between an outside extremity of the member for stopping and a wall to which the slatwall track is secured and the spacing between the upwardly extending member and the same wall are equal and correspond to a thickness of a panel intended to be inserted, between two slatwall tracks, into these spacings.

1 Claim, 3 Drawing Sheets

U.S. PATENT DOCUMENTS 4,805,783 A * 2/1989 Mayer ..... 211/94.01
4,809,479 A * 3/1989 Tierno et al. ..... 52/588.1
4,852,213 A * 8/1989 Shewchuk ..... 16/266
4,891,897 A * 1/1990 Gieske et al. ..... 40/618
4,936,078 A * 6/1990 Porter ..... 52/592.1
4,944,416 A * 7/1990 Petersen et al. ..... 52/36.5
4,961,295 A * 10/1990 Kosch et al. ..... 52/36.5
4,998,304 A * 3/1991 Sauter et al. ..... 4/559
5,018,323 A * 5/1991 Clausen ..... 52/36.4
5,125,518 A * 6/1992 Ward ..... 211/87.01
5,138,803 A * 8/1992 Grossen ..... 52/36.4
5,148,925 A 9/1992 Althoff et al.
5,170,605 A * 12/1992 Huddle ..... 52/588.1
5,337,903 A * 8/1994 Wolcovitch et al. ..... 211/85.1
5,409,120 A * 4/1995 Miller et al. ..... 211/85.26
5,412,912 A 5/1995 Alves
5,595,038 A * 1/1997 Prestenback ..... 52/592.1
5,647,184 A * 7/1997 Davis ..... 52/592.1
5,657,885 A 8/1997 White et al.
D393,907 S * 4/1998 Current ..... D25/122
5,740,927 A 4/1998 Yemini
D395,089 S * 6/1998 Current ..... D25/123
5,775,521 A * 7/1998 Tisbo ..... 211/94.01
5,791,093 A * 8/1998 Diamond ..... 52/36.5
D399,010 S * 9/1998 Current ..... D25/123
D399,012 S * 9/1998 Current ..... D25/123
D400,270 S * 10/1998 Current ..... D25/123
5,819,490 A 10/1998 Current
5,819,491 A * 10/1998 Davis ..... 52/592.1
D403,085 S * 12/1998 Current ..... D25/123
D404,148 S * 1/1999 Laskowski et al. ..... D25/123
5,899,344 A * 5/1999 Current et al. ..... 211/94.01
5,941,026 A 8/1999 Eisenreich et al.
5,944,203 A 8/1999 Vlah et al.
D414,567 S * 9/1999 Burt et al. ..... D25/123
6,006,486 A * 12/1999 Moriau et al. ..... 52/589.1
6,050,426 A 4/2000 Leurdijk
6,073,399 A * 6/2000 Shipman et al. ..... 52/36.1
6,119,878 A * 9/2000 Zen ..... 211/94.01
6,131,355 A * 10/2000 Groh et al. ..... 52/592.1
6,134,846 A 10/2000 Lamb
6,164,467 A * 12/2000 DePottey et al. ..... 211/189
6,185,899 B1 * 2/2001 De Niet ..... 211/187
6,220,461 B1 * 4/2001 Dickinson ..... 248/225.11
6,311,955 B1 * 11/2001 McGarry et al. ..... 256/24
6,325,223 B1 * 12/2001 Hannen ..... 211/87.01
6,349,507 B1 * 2/2002 Muellerleile ..... 52/36.5
6,421,961 B1 * 7/2002 Mallozzi ..... 52/36.5
D473,664 S * 4/2003 Perkins et al. ..... D25/138
6,564,952 B1 * 5/2003 Suttles ..... 211/187
D482,802 S * 11/2003 Yates, Jr. ..... D25/121
6,772,890 B2 8/2004 Campbell et al.
7,007,433 B2 * 3/2006 Boyer ..... 52/309.9
7,055,703 B2 6/2006 Perkins et al.
7,086,542 B2 8/2006 Tomonari et al.
7,104,023 B1 9/2006 Holztrager
D551,781 S * 9/2007 Abdullah ..... D25/123
7,322,157 B2 * 1/2008 Hang ..... 52/506.08
7,464,511 B2 * 12/2008 Kosch ..... 52/520
2001/0047971 A1 * 12/2001 Chance et al. ..... 211/87.01
2005/0006539 A1 * 1/2005 Fischer et al. ..... 248/220.42
2005/0127016 A1 * 6/2005 Fischer ..... 211/94.01
2006/0091094 A1 * 5/2006 Schuberth ..... 211/94.01
2006/0207201 A1 9/2006 Klimek
2007/0079561 A1 * 4/2007 Hopkins ..... 52/36.5
2008/0105636 A1 * 5/2008 Lawson ..... 211/94.01
2008/0105637 A1 * 5/2008 Lawson ..... 211/94.01

* cited by examiner

Figure 3
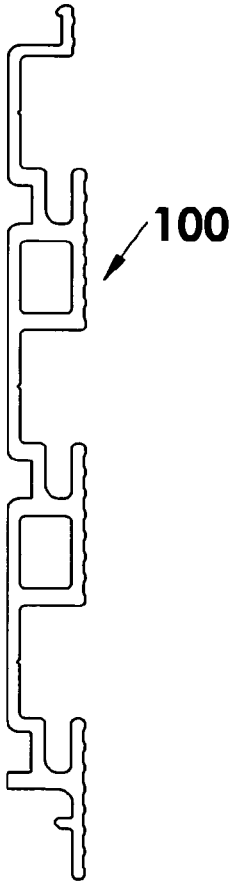
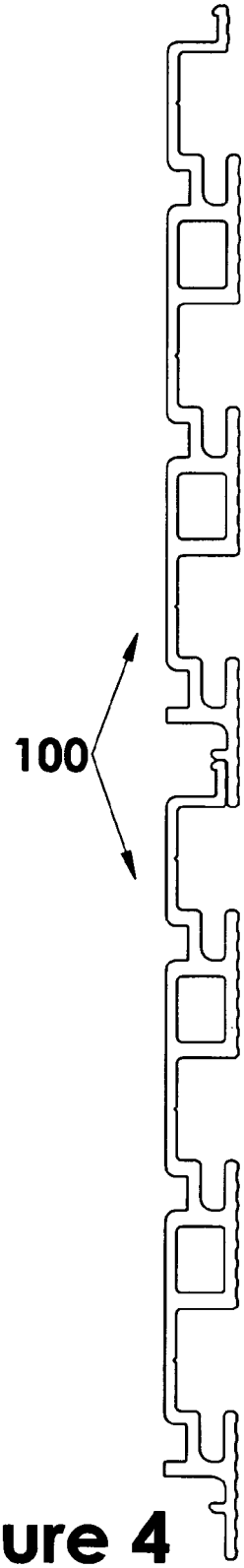
Figure 4
Figure 5
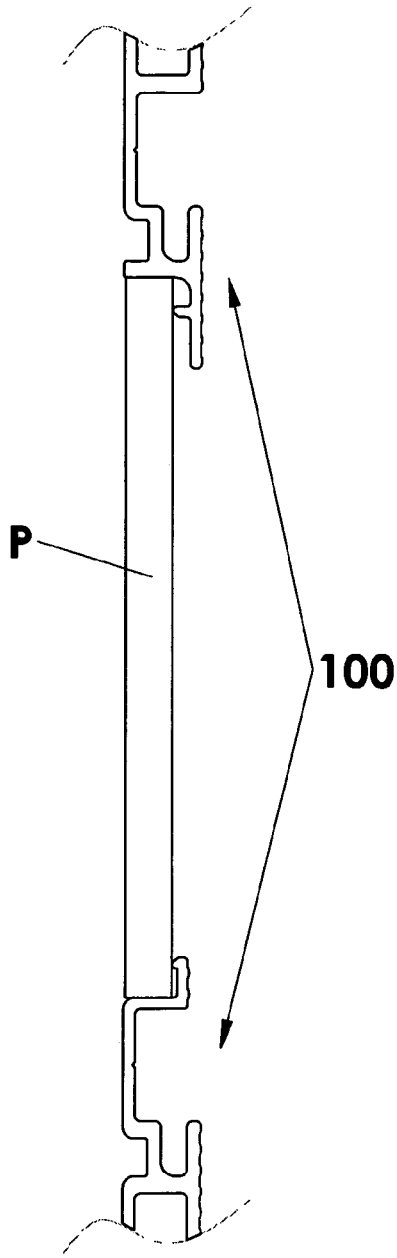

SLATWALL TRACK

I. BACKGROUND OF THE INVENTION

1. Definition of the Invention

The present invention relates, in general, to workroom and garage storage organizers and, in particular, to a slatwall track.

2. Description of the Prior Art

The walls of a building in residential, commercial and industrial buildings are frequently provided with one or more slatwall tracks used to display a variety of objects off the floor of the building. The objects can be similar, such as in a display for merchandise in retail stores, for example shoes, or they can vary in shape, size, weight and type, such as in a garage or workshop, etc. to suspend, for example, gardening or other handtools.

The slatwall tracks are made of metal, metal alloys or plastic and formed by an extrusion process.

Slatwall tracks are generally secured to a building structure, which includes without limitation any walls, such as temporary or permanent walls. The walls may or may not be covered with wallboard. The slatwall tracks are attached with screws directly to walls having physical strength, to an existing frame or studs normally used to hold the wallboard.

Often a slatwall track is interlockingly connected with a similar upper and lower slatwall tracks. Sometimes there is spacing between slatwall tracks in which case that spacing must be uniform to provide an even and aesthetically pleasing surface.

When slatwall tracks are mounted on the walls of a workroom or a garage, in order to create an appealing, more pleasant environment, the choice is generally limited to the use of wallboard which must be usually painted.

Attempts to improve the structural configuration of slatwall tracks have been made and are reflected in patents. Thus, for example, U.S. Pat. No. 5,819,490 granted on Oct. 13, 1998 to Current for a "SLATWALL SECTION AND METHOD FOR MAKING THE SAME" describes a slatwall track of uniform thickness with an upper and lower leg for intermeshing with contiguous above or bellow identical slatwall tracks. The upper and lower leg are provided with holes for securing them together and also to a wall. The total thickness of both legs is equal to the uniform thickness of the remainder of the slatwall track. The main shortcomings of the foregoing slatwall track reside in the fact that in reality there is no uniform thickness throughout the entire track, which complicates the extrusion process, and an attachment to a wall is not specifically designed for a single track, which can be sometimes the case. Another shortcoming is due to the fact that no means are provided to cover the spacing between spaced slatwall tracks when the securing wall is not a finished one. Moreover, the attachment of the track is located at the extremities of the latter and not along its center of symmetry.

Another example is U.S. Pat. No. 6,837,384 granted on Jan. 4, 2005 to Secondino for a "STORAGE TRACK" configured for use with a panel, such as a pegboard. The storage track is extruded with a horizontal "L" groove along its length for accepting most standard display accessories, such as hooks, shelf brackets, etc. The storage track incorporates as well two channels that run horizontally along its length to receive upper and lower panels. The upper channel mates with a bottom edge of the upper panel, while the lower channel mates with a top edge of the lower panel. Furthermore, the storage track is used in combination with hollow tubular elements to provide the necessary spacing between a wall, onto which the storage track is secured, and pegboard panels.

The latter float between the two horizontal channels of the storage tracks. One disadvantage of the foregoing storage track resides in the fact that there is no rigid and sufficient secure attachment of the pegboard panels to the storage track. Another disadvantage is due to the fact that there are no means provided to cover the spacing between spaced storage tracks, when the wall of the building was not finished.

Yet another example is International Patent Application WO 93/00846 published on 21 Jan. 1993 under the title "ARRANGEMENT FOR A HOLLOW PROFILE MOULDING", inventors Becker et al. This application describes an assembly of slatwall tracks horizontally extending and vertically succeeding, which are interlocked preferably with tongued and grooved type coupling. Each slatwall track incorporates front vertical elements so disposed that an opening is formed between two consecutive front vertical elements. The opening is adaptable to accommodate object supports. The assembly also includes fixtures which permit the detachable supporting of sheet-shaped panels. The main disadvantage of this assembly is the lack of means for retaining and securing an aesthetically appealing panel, between two consecutive slatwall tracks, flush with an unfinished wall to which the slatwall tracks are secured.

II. SUMMARY OF THE INVENTION

There is a urgent need, frequently expressed by the users, for an improved slatwall track which satisfies not only utility and functionality requirements but also the aesthetical aspects of workrooms and garages where slatwall are used. Hence, several objectives were established by the inventor.

A first objective is to provide a simple and robust slatwall track.

A second objective is to provide a versatile slatwall track that can either be used alone, or be interengaged with an upper or a lower or both upper and lower slatwall tracks, and is also adaptable to retain a decoration panel, when two consecutive slatwall tracks are used.

Broadly stating, the slatwall track according to the present invention comprises:

- a horizontally elongated integral body defined by an uniform thickness and by a front and a back side, and incorporates
  - an upwardly extending element adapted for intermeshing with another slatwall track mounted above it, the upwardly extending element adapted for intermeshing with another slatwall track being positionally retracted from the front side at a distance equal to the uniform thickness;
  - one or more subassemblies for receiving and capturing adapted to retain one or more elements for supporting suspended items, the one or more subassemblies for receiving and capturing being followed downwardly by
  - one or more rigidity components adapted for resisting to a leverage effect caused especially when the one or more elements for supporting suspended items are loaded with the latter, the one or more rigidity components adapted for resisting to a leverage effect being positioned to follow each of the one or more subassemblies for receiving and capturing,
  - a downwardly extending element adapted for intermeshing another slatwall track mounted bellow it, namely the downwardly extending element, being coplanar with the front side, frictionally engage the upwardly extending element adapted for intermeshing with another slatwall track mounted above it; and an element for stopping adapted to limit an upward insertion of the upwardly extending element adapted for intermeshing with another slatwall track, being perpendicularly and backwardly projecting from the downwardly extending element and having an outside extremity spaced from a back plan coplanar with an exterior surface of the back side; the upwardly extending means adapted for intermeshing having also an outside extremity equally spaced from a back plan coplanar with an exterior surface of the back side whereby a spacing, adapted for insertion of a panel between two slatwall tracks disposed in parallel and spaced vertically, is formed.

More specifically, the slatwall track comprises, in combination, an integral body structure formed with a uniform thickness throughout the whole its structure and having a front and a back side;

an upwardly extending horizontal protrusion adapted for an intermeshing with another slatwall track situated above it, the upwardly extending horizontal protrusion being retracted from front side at a distance equal with the uniform thickness;

an rearward extending horizontal wall starting from a bottom of the upwardly extending horizontal protrusion. The former and the latter defining a first step-shaped rabbet and ending into the back side, followed by a vertical wall horizontally extending as part of the back side and, then, continued at its bottom by a first forwardly extending horizontal segmental wall;

a channel, generally of rectangular shape, with an opening in the front side, formed by the the foregoing walls;

a U-shaped channel expanding downwardly from the channel and retracted from the back side, and having an external leg coplanar with the front side; the channel and the U-shaped channel having each a length commensurate with a whole length of said slatwall track;

a closed box section extending downwardly from said U-shaped channel and defined by a frontal wall stretching down from said external leg and coincidental with a portion of the front side, by a rear wall coincidental with a portion of the back side and continued at its top by a second forwardly extending horizontal segmental wall and at its bottom by a forwardly extending horizontal wall;

another channel extending into another U-shaped channel and located beneath the closed box section is followed downwardly by another closed box;

yet another channel extending into an other U-shaped channel downwardly;

a limiting horizontally wall incorporating a second forwardly extending horizontal segmental wall and a bottom of a last U-shaped channel stretches from the front side and reaches a back plan coplanar with an exterior surface of the back side;

an downwardly extending horizontal protrusion adapted for an intermeshing with another slatwall track situated beneath it; and a rearward projecting tongue horizontally extending and perpendicular to the downwardly extending horizontal protrusion. The former and the latter defining a second step-shaped rabbet designed to stop the upwardly extending horizontal protrusion of a lower-contiguous slatwall track when the latter abuts it, after the upwardly extending horizontal protrusion frictionally engaged the downwardly extending horizontal protrusion; a length of said rearward projecting tongue being conveniently chosen that a panel having a specific thickness is adaptable to be inserted between an outside end of the rearward projecting tongue and a wall coplanar with a back plane, the latter being coplanar with the back side;

correspondingly, the upwardly extending horizontal protrusion being adapted to frictionally engage the downwardly extending horizontal protrusion of an upper contiguous slatwall track until the rearward projecting tongue of the latter abuts and, thus, is stopped by a top end of the upwardly extending horizontal protrusion; thus, a distance between the upwardly extending horizontal protrusion and the wall coplanar with the back side is so conveniently chosen that is adaptable for an insertion of a panel having a specific thickness;

whereby the channels together with the U-shaped channels are adaptable to receive and capture supporting features; and the vertical wall being provided with a notch along its horizontally extending midline defines an indentation for guiding fastening means during mounting of the slatwall track.

III. BRIEF DESCRIPTION OF THE DRAWINGS

The subject matter of the invention is particularly pointed out and distinctively claimed in the concluding portion of the specification. The invention, however, both in structure and operation may be better understood by reference to the following description taken in conjunction with the subjoined claims and the accompanying drawings of which FIG. 1 shows an end elevation view of a slatwall track according to present invention;

FIG. 3 shows the same slatwall as in FIGS. 1 and 2 when used alone, depicted besides FIG. 4 which shows two interlocked slatwall tracks; and FIG. 5 shows two fragmentary successive slatwall tracks as those depicted in the foregoing drawings, between which a panel is interposed.

IV. DESCRIPTION OF THE PREFERRED EMBODIMENTS

Before the various embodiments of the present invention are explained in detail, it is to be understood that the invention is not limited in its application to the details of construction and the arrangements of components set forth in the following description or illustrated in the accompanying drawings. The invention is capable of other embodiments and of being practiced or of being carried out in various ways. Also, it is to be understood that the terms used herein with reference to the orientation of a slatwall track (such as, for example, terms like "front", "back", "upper", "lower", "horizontal", "vertical", and the like), are only used to better understand the description of the present invention, and do not alone indicate or imply that the invention and its uses, referred to, must have a particular position.

Figure 1:
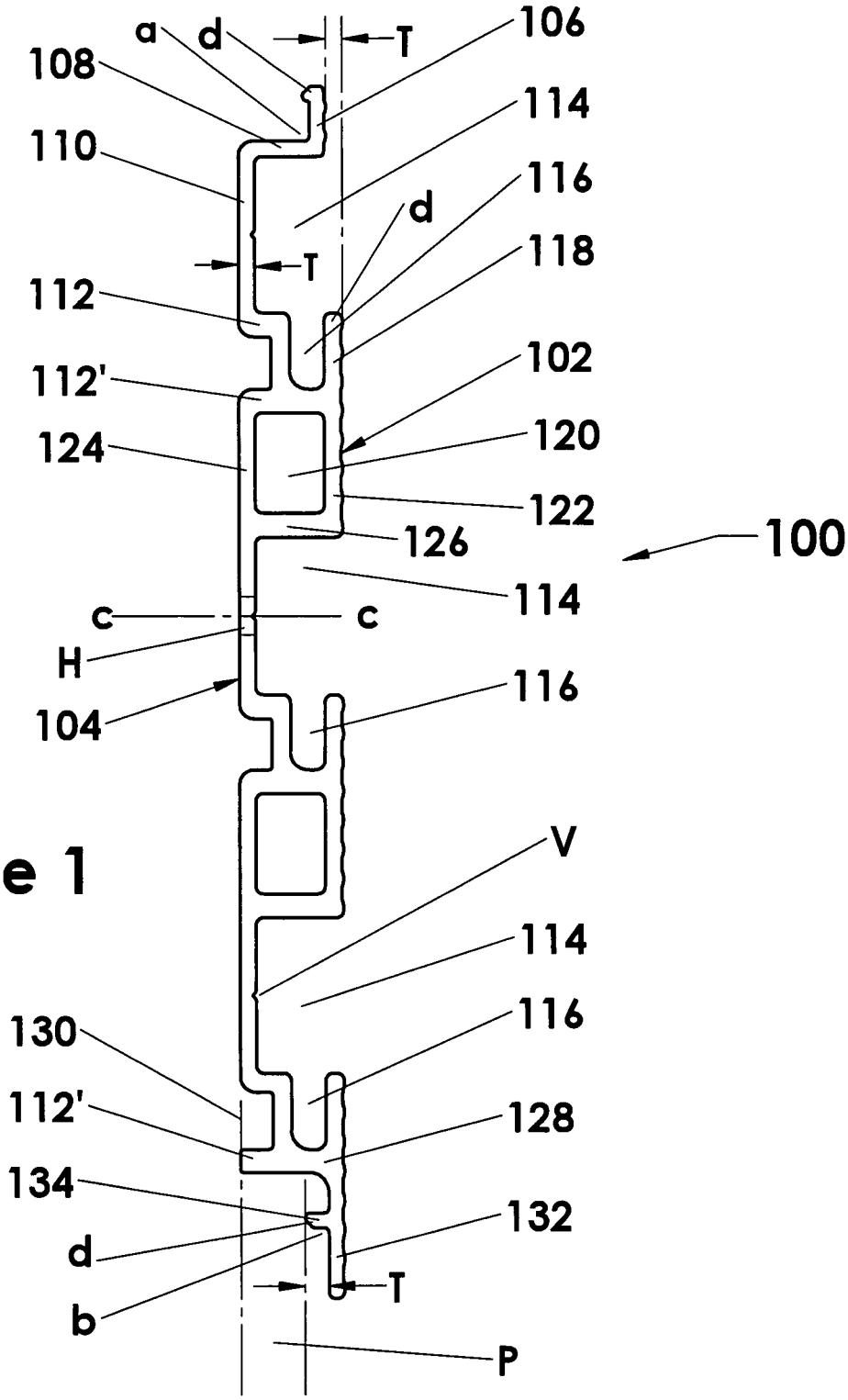

Turning now to the accompanying drawings, FIG. 1 shows an extruded, horizontally elongated slatwall track 100, named "slatwall track 100" or "slatwall track" elsewhere in this specification, which comprises:

an integral body structure generally formed with a uniform thickness T throughout the whole of its structure and having a front and a back side 102 and 104;

an upwardly extending horizontal protrusion 106 adapted for intermeshing with another slatwall track 100 situated above it (see FIG. 4), upwardly extending horizontal protrusion 106 being retracted from front side 102 by a distance equal with uniform thickness T;

a rearwardly extending horizontal wall 108 starting from bottom of upwardly extending horizontal protrusion 106 (the former and the latter defining a first step-shaped rabbet a) and ending into back side 104, followed by a vertical wall 110 horizontally extending as part of back side 104 and, then, continued at its bottom by a first forwardly extending horizontal segmental wall 112;

a channel 114, generally of rectangular shape with an opening in front side 102, formed by the foregoing walls;

a U-shaped channel 116 expanding downwardly from channel 114 and retracted from back side 104, and having an external leg 118 coplanar with front side 102; channel 114 and U-shaped channel 116 having a length commensurate with the whole length of slatwall track 100;

a closed box section 120 extending downwardly from U-shaped channel 116 has a frontal wall 122 stretching down from external leg 118 and coincidental with a portion of front side 102, a rear wall 124 coincidental with a portion of back side 104 and continued at its top by a second forwardly extending horizontal segmental wall 112' and at its bottom by a forwardly extending horizontal wall 126;

another channel 114 extending into U-shaped channel 116 is located beneath closed box section 120 and is continued downwardly by another closed box 120 yet another channel 114 extending into U-shaped channel 116 follows downwardly;

a limiting horizontally wall 128 incorporating a second forwardly extending horizontal segmental wall 112' and a bottom of a U-shaped channel 116 stretches from front side 102 and reaches a back plane 130 coplanar with the exterior surface of back side 104;

a downwardly extending horizontal protrusion 132 adapted for an intermeshing with another slatwall track 100 situated beneath it; and a rearward projecting tongue 134 perpendicular to downwardly extending horizontal protrusion 132 (the former and the latter defining a second step-shaped rabbet b) is designed to stop upwardly extending horizontal protrusion 106 of a lower-contiguous slatwall track 100 when the latter abuts it after upwardly extending horizontal protrusion 106 frictionally engaged downwardly extending horizontal protrusion 132; the length of rearward projecting tongue 134 is conveniently chosen that a panel P having a specific thickness (for example, a ¼" melamine panel) is adaptable to be inserted between an outside end of rearward projecting tongue 134 and a wall coplanar with back plan 130;

correspondingly, upwardly extending horizontal protrusion 106 is adapted to frictionally engage downwardly extending horizontal protrusion 132 of an upper contiguous slatwall track 100 until rearward projecting tongue 134 of the latter abuts and, thus, is stopped by a top end of upwardly extending horizontal protrusion 106; a distance between upwardly extending horizontal protrusion 106 is so conveniently chosen that is adaptable for the insertion of panel P (see FIG. 5) having a specific thickness.

Figure 2:
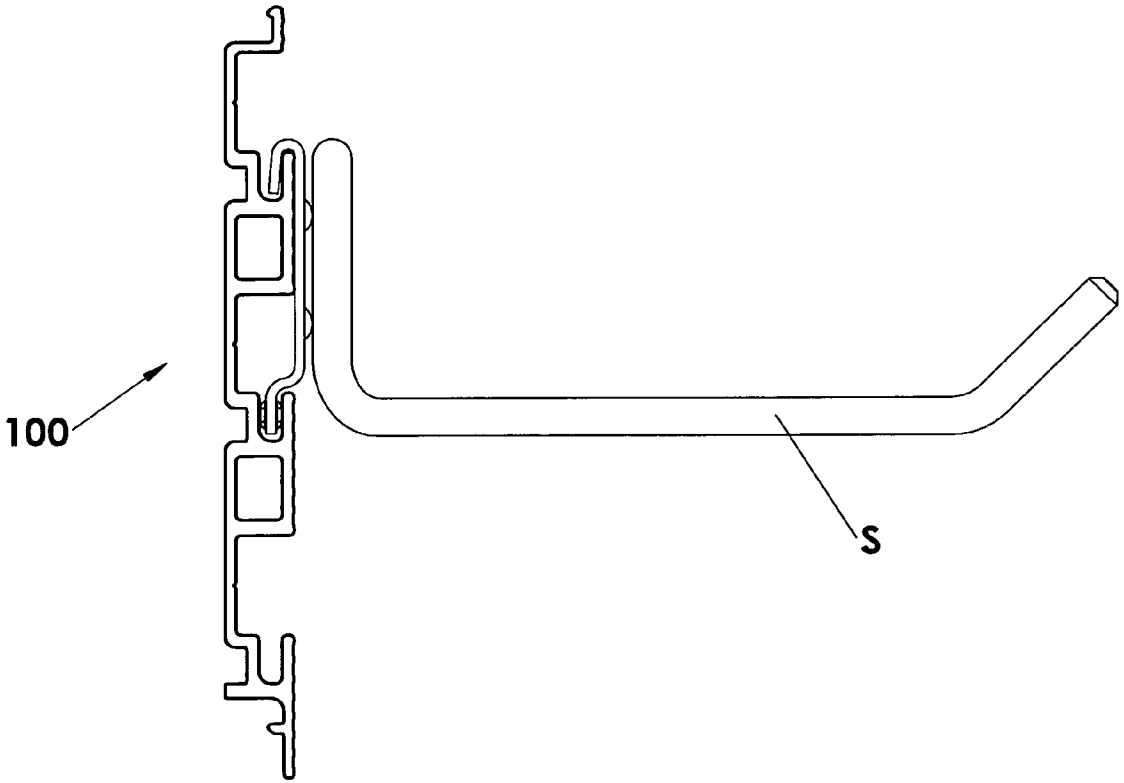
FIG. 2 shows the same slatwall track as in FIG. 1, with a supporting feature retained into it.

The channels 114 together with U-shaped channels 116 are designed to receive and capture supporting features S (see FIG. 2) such as hangers, brackets, etc. which in turn support items that are being displayed or suspended. Although slatwall track 100 is described and shown with channels 114 and U-shaped channels 116, the former having a rectangular cross-section and the latter a U-shaped cross-section, other channel configurations may be used.

In the foregoing embodiment of the invention, three vertically spaced and horizontally extending channels 114 are described together with their corresponding U-shaped channels 116.

It is to be understood that the number of channels can differ depending on the required number of supports S and the design of the latter. Thus, slatwall track 100 may be formed with one or more channels.

Several screws (not shown) are used for attachment of slatwall track 100 to a wall, frame or studs. The screws penetrate into one of the foregoing places of attachment via vertical wall 110 which is slightly notched to define a V-shaped indentation V along its horizontally extending midline c. V-shaped indentation V is used for guiding the screws during mounting of slatwall track 100. Vertical wall 110 is adaptable to incorporate holes H aligned on midline c and sized for receiving the screws.

Closed box 120 shown in the drawings is of rectangular configuration. Alternatively, other configurations can be used as long as closed box 120 provides sufficient rigidity to resist leverage applied by a cantileverly supported item.

The foregoing embodiment of the invention incorporates two closed boxes 120. Generally, a closed box 120 is intercalated between two consecutive channels 114 and U-shaped channels 116.

Upwardly extending horizontal protrusion 106, downwardly extending horizontal protrusion, downwardly extending horizontal protrusion 132, rearward projecting tongue 134 and external leg 118 have rounded outside extremities d for facilitating the engagement with those items intended to match with.

As required, a detailed embodiment of the present invention is disclosed herein; however, it is to be understood that the disclosed embodiment is merely exemplary of the invention which may be embodied in various forms. Therefore, specific structural and functional details disclosed herein are not to be interpreted as limiting, but merely as a basis for the claims and as representative basis for teaching one skilled in the art to variously employ the present invention in virtually any appropriately detailed structure.

What I claim is:

1. A slatwall track comprising, in combination, an integral body structure formed with a uniform thickness throughout the whole of its structure and having a front and a back side;

an upwardly extending horizontal protrusion adapted for an intermeshing with another slatwall track situated above it, said upwardly extending horizontal protrusion being retracted from said front side at a distance equal with said uniform thickness;

a rearward extending horizontal wall starting from a bottom of said upwardly extending horizontal protrusion, said rearward extending horizontal wall and said upwardly extending horizontal protrusion defining a first step-shaped rabbet ending at said back side, followed by a vertical wall horizontally extending as part of said back side and, then, continued at its bottom by a first forwardly extending horizontal segmental wall;

a first channel, generally of rectangular shape, with an opening in said front side formed by said rearward extending horizontal wall, said vertical wall horizontally extending as part of said back side and said first forwardly extending horizontal segmental wall;

a first U-shaped channel expanding downwardly from said first channel and retracted from said back side via said first forwardly extending horizontal segmental wall and having an external leg coplanar with said front side; said first channel and said first U-shaped channel each having a length commensurate with a whole length of said slatwall track;

a closed box section extending downwardly from said first U-shaped channel and defined by a frontal wall stretching down from said external leg and coincidental with a portion of said front side, by a rear wall, coincidental with a portion of said back side and continued at its top by a second forwardly extending horizontal segmental wall and at its bottom by a forwardly extending horizontal wall;

a second channel extending into a second U-shaped channel being located beneath said closed box section, which is then followed downwardly by another closed box, followed by;

a third channel extending into a third U-shaped channel;

a limiting horizontally wall, located beneath said third U-shaped channel, and incorporating a second forwardly extending horizontal segmental wall and a bottom of said third U-shaped channel, said limiting horizontally wall stretching from said front side and reaching a back plane coplanar with an exterior surface of said back side;

a downwardly extending horizontal protrusion, located beneath said limiting horizontally wall, is adapted for intermeshing with another slatwall track situated beneath it; and a rearward projecting tongue horizontally extending and perpendicular to said downwardly extending horizontal protrusion, said rearward projecting tongue and said downwardly extending horizontal protrusion defining a second step-shaped rabbet which is adapted to stop said upwardly extending horizontal protrusion of a lower-contiguous slatwall track after said upwardly extending horizontal protrusion of said lower-contiguous slatwall track frictionally engages said downwardly extending horizontal protrusion; a length of said rearward projecting tongue being conveniently chosen that a panel having a specific thickness is adapted to be inserted between an outside end of said rearward projecting tongue and a wall coplanar with said back plane;

correspondingly, said upwardly extending horizontal protrusion being adapted to frictionally engage a downwardly extending horizontal protrusion of an upper contiguous slatwall track until said rearward projecting tongue of said upper contiguous slatwall track and, thus, is stopped by a top end of said upwardly extending horizontal protrusion; thus, a distance between said upwardly extending horizontal protrusion and a back plane coplanar with said back side being conveniently chosen to be adapted for insertion of a said panel having a specific thickness, whereby said first, second and third channels together with said first, second and third U-shaped channels adapted to receive and capture supporting features; and said vertical wall, being slightly bent along its horizontally extending midline, thereby defining an indentation for guiding fastening means during mounting of said slatwall track.

* * * * *